US005405502A

United States Patent [19]

Palmu et al.

[11] Patent Number: 5,405,502

[45] Date of Patent: Apr. 11, 1995

[54] APPARATUS FOR TREATING BLACK LIQUOR

[75] Inventors: Kari Palmu; Markku Tanttu, both of Varkaus, Finland

[73] Assignee: A. Ahlstrom Corporation, Noormarkku, Finland

[21] Appl. No.: 87,461

[22] Filed: Jul. 8, 1993

[30] Foreign Application Priority Data

Jul. 10, 1992 [FI] Finland ..... 923179

[51] Int. Cl.[6] ..... D21C 11/00

[52] U.S. Cl. ..... 162/239; 162/246; 162/29; 162/30.1; 162/52; 162/57; 366/14

[58] Field of Search ..... 162/29, 30.1, 239, 57, 162/246, 52; 366/154, 155, 156, 14, 15

[56] References Cited

U.S. PATENT DOCUMENTS 2,702,235 2/1955 Hochmuth ..... 23/262

*Primary Examiner*—W. Gary Jones

*Assistant Examiner*—Dean T. Nguyen

*Attorney, Agent, or Firm*—Nixon & Vanderhye

[57] ABSTRACT

A simplified method and apparatus for handling black liquor (or other spent liquor from the pulp industry) includes utilization of a mixing tank directly with a black liquor storage tank. The mixing tank has a side wall defined by a part of the side wall of the black liquor storage tank, and the mixing tank may either be disposed within the volume of the storage tank, or immediately exterior of it. Fly ash from a recovery boiler and make-up chemical are introduced into the mixing tank along with black liquor from evaporators, and the mixed liquid from mixing tank overflows into the interior volume of the black liquor storage tank. From the storage tank the black liquor is sent to a recovery boiler where it is burned. Also, some black liquor from the recovery boiler is recirculated to the storage tank, and introduced into the storage tank remote from the mixing tank.

16 Claims, 4 Drawing Sheets

APPARATUS FOR TREATING BLACK LIQUOR

BACKGROUND AMD SUMMARY OF THE INVENTION

The present invention relates to a method and apparatus for treating spent liquor from the pulp industry, whereby the spent liquor is introduced into a mixing tank for adding ash and/or other substances to the spent liquor.

The spent liquor, i.e. black liquor produced in the manufacture of chemical pulp in the pulp industry, is normally incinerated in a chemicals and heat recovering boiler. In a conventional recovery boiler, the process chemical is recovered by injecting liquor into the furnace, whereby the liquor dries rapidly and burns in reducing conditions, producing a melt. The melt primarily contains sodium carbonate, sodium sulfide and sodium sulfate, however a large number of other compounds are also present. The main components, $Na_2CO_3$ and $Na_2S$, are essential to the manufacture of cellulose pulp, particularly kraft pulp.

The flue gases from the recovery boiler contain abundant quantities of ash ("fly ash"), which is typically separated in an ash hopper and electrostatic filters prior to exhausting the flue gas from the boiler.

The main component of this fly ash is sodium sulfate. Usually, the fly ash is recycled to the soda recovery boiler by mixing the ash with the strong black liquor which is to be introduced into the boiler. However a significant problem area in the black liquor treatment process is the mixing of fly ash and make-up chemical (e.g. $Na_2SO_4$), if any, with the black liquor. Conventionally, a separate, fairly large mixing tank is provided, in which the ash is mixed with the black liquor coming from evaporators of an evaporation plant (via a storage tank) into the mixing tank. Black liquor is also returned from the liquor circulation of the boiler to the mixing tank.

The black liquor storage and treating system of the prior art has many problems associated therewith. When returned from the boiler to the mixing tank, the hot black liquor emits vapors which contain substantial quantities of impurities. Vapor is carried to the ash transportation means where it causes malfunctions, requiring frequent maintenance and cleaning of the system. The costs are high because of the separate, large mixing tank. There are also a large number of pumps and much piping. As the whole system is complicated and requires numerous pieces of equipment, operating and maintenance costs are high.

According to the present invention, a method and apparatus for storing and treating of black liquor which are simpler, more economical, and more reliable in operation than the prior art described above, is provided. A feature of the method according to the present invention is that the mixing tank is connected to the spent liquor storage tank so that mixed liquid is discharged directly into the storage tank. A feature of the apparatus according to the invention is that a volume is provided with a mixer connected to the spent liquor storage tank, the storage tank defining a part of the mixing volume.

The invention essentially improves the reliability in operation of the mixing procedure. The ash and salt cake mix more uniformly with the black liquor, vapor emissions do not cause the types of problems of conventional mixing tank systems, and the system is simple and reliable. Several pumps and pipes necessary in the prior art system may be eliminated.

One aspect of the invention comprises: A spent liquor storage tank having a liquid outlet from a bottom portion thereof, and including a sidewall defining an interior. Means defining a mixing tank having a much smaller interior volume than the storage tank, the means including the sidewall of the storage tank. Means for mixing fly ash and spent liquor in the mixing tank. Means for introducing fly ash and spent liquor into the mixing tank. And, means for discharging mixed fly ash and spent liquor from the mixing tank directly into the interior of the storage tank.

Another aspect of the invention comprises: A black liquor storage tank having a top and a bottom, including a liquid outlet adjacent the bottom thereof, and an interior volume. A recovery boiler connected to the liquid outlet, and producing fly ash. A recirculating conduit connected from the recovery boiler to the storage tank interior volume. A mixing tank remote from the recirculating conduit having a discharge opening in direct communication with the storage tank interior volume. Black liquor evaporators. Means for connecting the black liquor evaporators to the mixing tank for introducing black liquor from the evaporators into the mixing tank. Means for introducing fly ash from the recovery boiler into the mixing tank. And, mixing means associated with the mixing tank for mixing black liquor and fly ash therein to produce a liquid mixture that is discharged through the discharge opening directly into the storage tank interior volume.

Another aspect of the invention comprises the following method steps for treating spent liquor from pulping: (a) Concentrating the spent liquor. (b) Feeding the concentrated liquor into the mixing volume. (c) Introducing fly ash, and optionally makeup chemical, into the mixing volume. (d) Mixing the concentrated liquor, fly ash, and optionally makeup chemical, in the mixing volume to provide a liquid mixture. (e) Discharging the liquid mixture directly into the interior of the storage tank from the mixing volume, without utilizing any conduits external of the storage tank. (f) Withdrawing liquid mixture from the storage tank and introducing it into the recovery boiler to be burned. And, (g) recirculating a part of the liquid mixture from the recovery boiler back to the storage tank. The invention provides a simplified and advantageous method and apparatus for handling black liquor or like spent liquor.

DETAILED DESCRIPTION OF THE DRAWINGS

Figure 1:
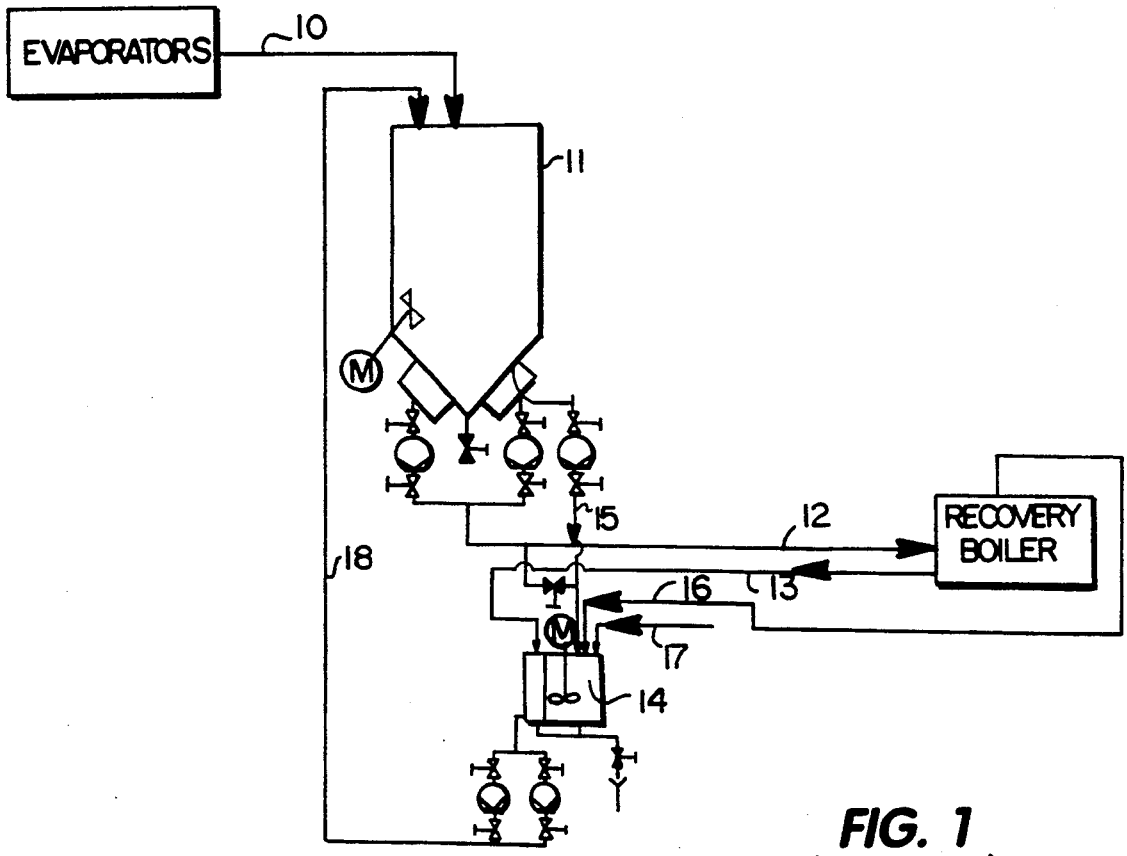
FIG. 1 (PRIOR ART)
FIG. 1 is a schematic side view of a prior art black liquor treating system.

A conventional black liquor treatment and storage system is similar to that shown in FIG. 1. The black liquor 10 coming from evaporators, etc., of a conventional evaporation plant is stored in one or more strong liquor tanks 11. The black liquor is pumped from the strong liquor tanks 11 via line 12 to a conventional recovery boiler for incineration. Extra liquor from the liquor circulation of the boiler is returned via line 13 to the mixing tank 14. A separate circulation system from the strong liquor tank 11 to the mixing tank 14 is also typically provided. Thus, the black liquor is conveyed via line 15 to the mixing tank 14 where the ash 16 from the recovery boiler and make-up chemical (e.g. $Na_2SO_4$) in line 17 are added to it. The black liquor is circulated via line 18 to the storage tank 11 after mixing.

Figure 2:
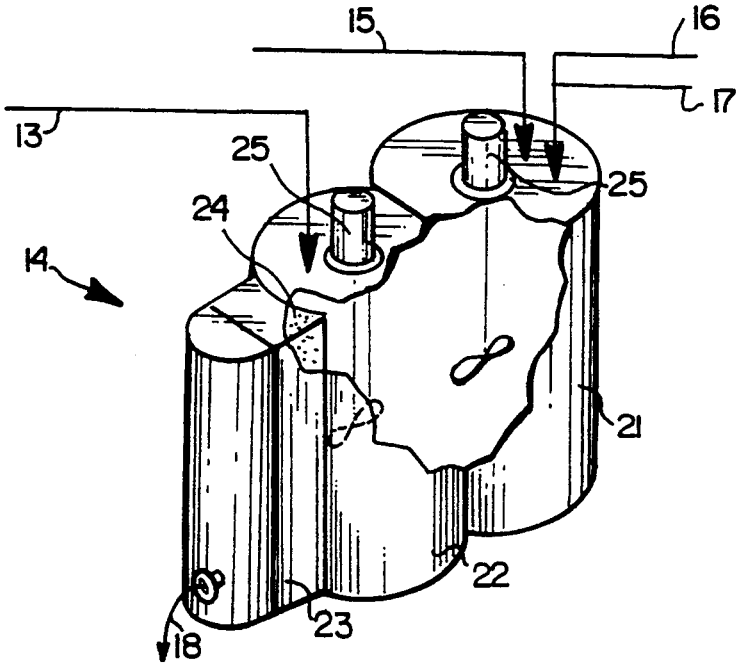
FIG. 2 (PRIOR ART)
FIG. 2 is a schematic perspective view of a prior art mixing tank, in which ash is added to the black liquor.

FIG. 2 illustrates in more detail the structure of a conventional mixing tank 14. The mixing tank 14 has one or two compartments and it is provided with a suction chamber. FIG. 2 shows a conventional two-compartment mixing tank 14. Ash 16 and a salt addition 17, if any, are supplied to the first compartment 21 of the mixing tank 14. Black liquor 15 from the storage tank 11 is also conveyed to the first compartment 21 of the tank 14. A first mixer 25 mixes the liquor, ash and salt. The liquid mixture is carried to the second compartment 22 of the tank 14, which is also provided with a mixer 25. Liquor 13 returning from the recovery boiler is also conveyed to compartment 22. A perforated plate 24, serving as a screen, is disposed between the tank compartment 22 and suction chamber 23. From the suction chamber 23, black liquor in line 18 is returned to the storage tank 11.

The system of FIGS. 1 and 2 has problems associated therewith. Emitted vapor is carried to the ash and salt feed means 16, 17 causing malfunctions. Efficient mixers 25 are necessary for mixing of the ash and salt. The screen 24 disposed in the suction chamber 23 of the mixing tank 14 becomes clogged, and thus often must be cleaned, and maintenance and cleaning of the equipment is difficult in other respects as well.

Figure 3:
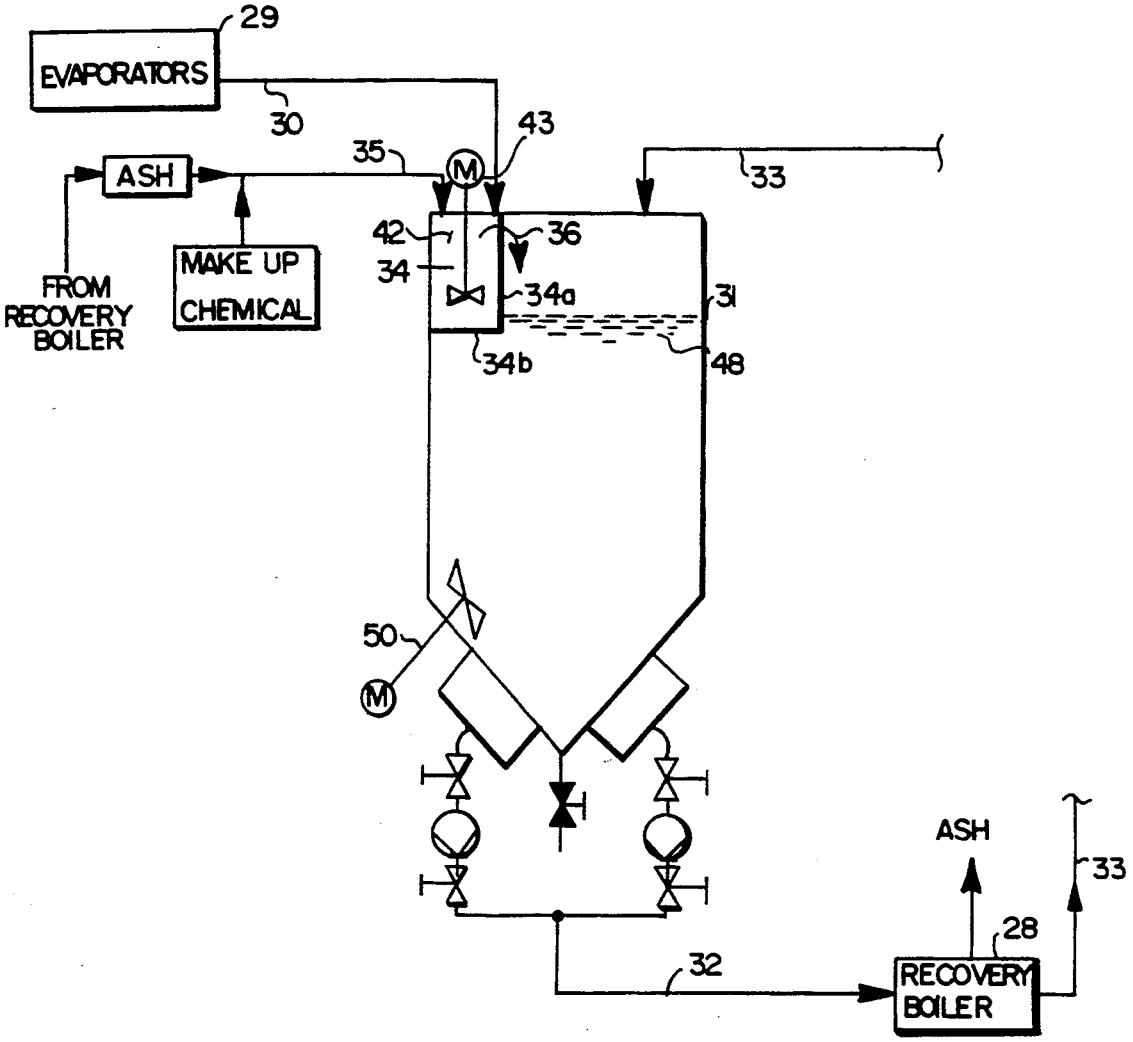
FIG. 3 is a schematic side view of an exemplary black liquor treating system according to the invention.
Figure 4:
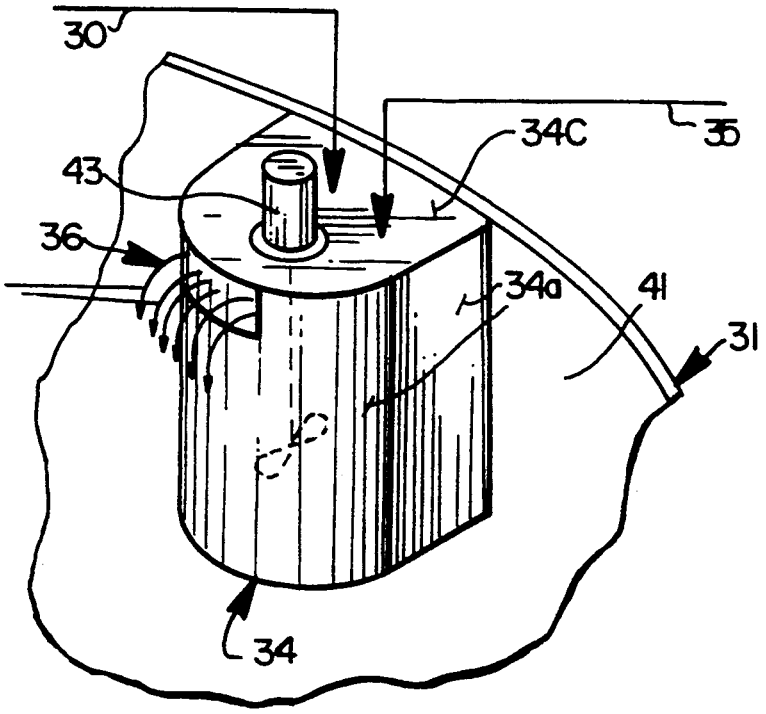
FIG. 4 is a detail perspective view of a part of the system of FIG. 3.

An exemplary black liquor treating system in accordance with the present invention is illustrated schematically in FIG. 3. Black liquor coming from the evaporation plant 29 via line 30 is stored in one or two storage tanks 31. From the tank or tanks 31, the black liquor is pumped via line 32 to the recovery boiler 28 for incineration. Extra black liquor returning from the boiler 28 is conveyed via line 33 to the black liquor storage tank 31 (not to a separate external mixing tank as in the prior art). In accordance with the invention, a mixing tank 34 is provided, but disposed in the immediate vicinity of the black liquor storage tank 31, typically within it as seen in FIGS. 3 and 4. The ash and make-up chemical, if any, to be added to the black liquor are fed to the mixing tank 34 in the black liquor storage tank 31 via line 35. The mixing tank 34 comprises a volume separated from the storage tank 31 by a solid partition wall or walls **34*a* and a solid bottom 34*b*, which space is in communication, through an overflow opening or like means 36, with the interior of the storage tank 31 for transferring treated liquor thereto. The sidewall 41 (see FIG. 4) of the tank 31 also defines part of the tank 34**.

FIG. 4 is a more detailed illustration of a preferred embodiment for implementing the mixing tank 34 according to the invention. The mixing tank 34, defined by walls **34*a*, bottom 34*b*, and solid top 34*c*, is dispose in the upper section of the strong liquor tank 31, and is also formed by interior wall 41 thereof. The interior volume 42 (see FIG. 3) of the tank 34 is in direct communication (through opening 36) with the storage tank 31 interior volume. Black liquor is conveyed from the evaporation plant 29 via line 30 to the mixing tank Ash and a salt addition, if any, are also conveyed via line 35 to the tank 34. The mixing tank 34 is provided with a propeller agitator 43, which mixes ash and salt with the black liquor. From the mixing tank 34, the liquid mixture is discharged as an overflow 45 via slot 36 to the interior of the storage tank 31**.

Figure 5:
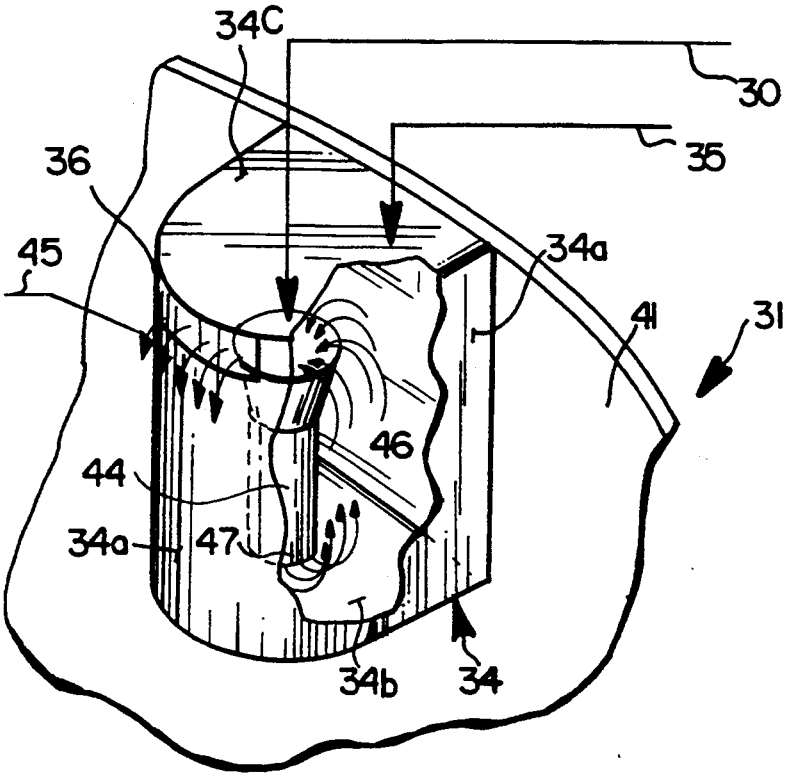
FIG. 5 is a view like that of FIG. 4 of a modification of the invention.

FIG. 5 illustrates (by the same reference numerals as in FIG. 4) a structure otherwise corresponding to that of FIG. 4, but in this structure, a suction pipe mixer 44 is disposed within the mixing tank 34' as the mixing means. The black liquor coming from the evaporation plant 29 is conveyed to the storage tank 31, or directly to the mixing tank 34' if desired. Black liquor may be circulated within the storage tank by a pump (not shown). Liquor in line 30, either from a pump or directly from evaporation plant 29, is conveyed to the upper section 46 of the suction chamber of suction pipe mixer 44. From the bottom end 47 of the suction mixer 44 the flow turns upwards entraining ash and salt-containing black liquor with it. From the mixing tank 34', the black liquor is discharged as an overflow 45 to the storage tank 31.

Figure 6:
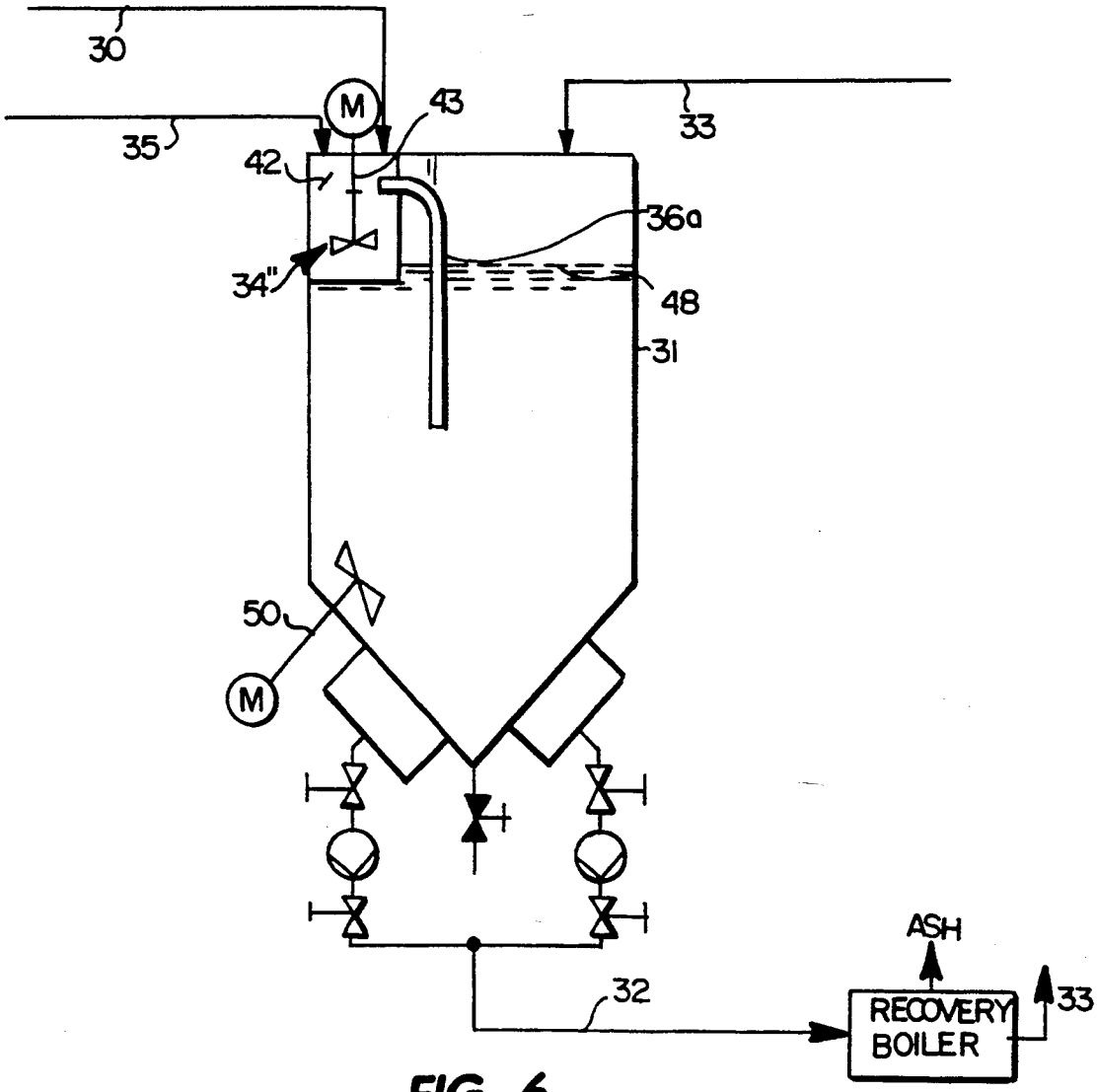
FIG. 6 is a view like that of FIG. 3 of another modification of a system according to the invention.

FIG. 6 illustrates another embodiment according to the present invention in which the mixing tank 34''0 is connected to the storage tank 31 by an overflow conduit **36*a* instead of an opening or a slot (36 in FIGS. 3–5). The reference numbers are the same as in FIG. 3 for respective items. The black liquor is here conveyed from the mixing volume 42 via conduit 36*a* to the storage tank 31, typically below the level of black liquor (e.g. 48**) therein.

Figure 7:
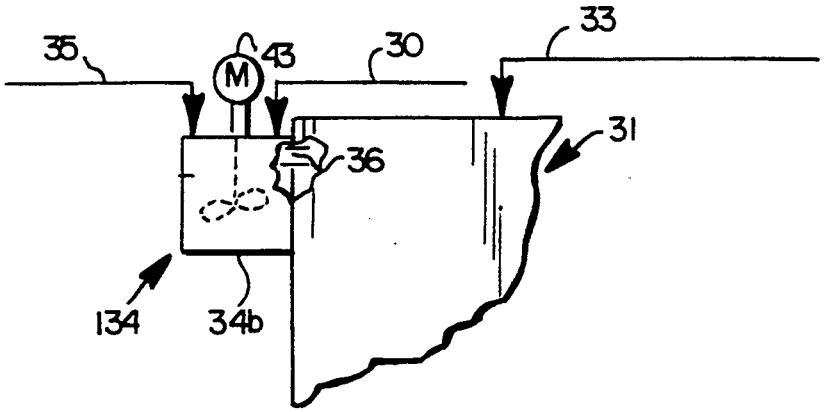
FIG. 7 is a partial side schematic view, like that of FIGS. 3 and 6, showing an external mixing tank.

In the embodiments of FIGS. 3–6, the mixing tank is disposed within the black liquor storage tank. An arrangement is also possible where the mixing tank, comprised of a closed volume in communication with the storage tank, is disposed outside the storage tank as a protruding part, as illustrated schematically at 134 in FIG. 7 (the rest of the reference numerals in FIG. 7 being the same as in FIGS. 3 and 4). Such an arrangement may ease maintenance work. In all embodiments another agitator 50 preferably is provided adjacent the bottom of tank 31.

The apparatus according to the present invention, in which a separate ash and salt mixing tank has been eliminated by providing the mixing tank 34, 34', 34'', 134 in immediate contact with the strong liquor tank 31, has numerous advantages associated therewith, such as:

- vapor emissions from the hot black liquor do not cause as many problems because the liquor is returned from the liquor circulation of the recovery boiler to the large storage tank;
- the ash and salt mix more uniformly with the black liquor;
- the mixing time of ash and salt is long, which is advantageous;
- the number of circulating pumps decreases;
- the number of tubes and valves decreases;
- less instrumentation is needed;
- the manufacture of the mixing tank within the strong liquor tank costs much less than that of a separate mixing tank;

- less cleaning is required;
- less maintenance is required;
- operating costs are decreased; and
- safety in operation is improved because the mixing tank is remote from the melt spout area.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for treating spent liquor from the pulp industry, comprising:

a spent liquor storage tank having a bottom, a liquid outlet adjacent said bottom, and including a sidewall defining an interior having a volume;

a mixing tank having a much smaller interior volume than said storage tank, said mixing tank including said sidewall of said storage tank and a bottom, said sidewall supporting said mixing tank bottom so that said mixing tank bottom is vertically above said storage tank bottom;

means for fixing fly ash and spent liquor in said mixing tank; means for introducing fly ash and spent liquor into said mixing tank; and means for discharging mixed fly ash and spent liquor from said mixing tank directly into the interior of said storage tank primarily by gravity flow.

2. Apparatus as recited in claim 1 further comprising a recovery boiler connected to said liquid outlet for burning liquid from said storage tank.

3. Apparatus as recited in claim 2 wherein said means for introducing spent liquor into said mixing tank comprises evaporators and a conduit extending between said evaporators and a top of said mixing tank.

4. Apparatus as recited in claim 3 wherein said said mixing tank further comprises one or more sidewalls disposed within said storage tank interior volume, and wherein said bottom is disposed within said storage tank interior volume.

5. Apparatus as recited in claim 4 wherein said discharging means comprises an overflow opening formed in a sidewall of said mixing tank and in direct communication with said storage tank interior.

6. Apparatus as recited in claim 4 wherein said discharging means comprises an overflow conduit extending from a sidewall of said mixing tank directly into the interior of said storage tank.

7. Apparatus as recited in claim 6 wherein a liquid level is established in said storage tank, and wherein said overflow conduit terminates below said liquid level.

8. Apparatus as recited in claim 6 wherein said mixing means comprises a suction pipe mixer having an open top and an open bottom, and wherein said means for introducing spent liquor into said mixing tank introduces the spent liquor directly into said open top of said suction pipe.

9. Apparatus as recited in claim 3 wherein said mixing tank further comprises one or more sidewalls disposed exteriorly of and attached to and supported by said storage tank sidewall, and wherein said bottom is connected to said sidewalls.

10. Apparatus as recited in claim 9 wherein said discharging means comprises an overflow opening formed in a sidewall of said mixing tank and in direct communication with said storage tank interior volume.

11. Apparatus as recited in claim 2 further comprising means for recirculating spent liquor from said recovery boiler into said storage tank interior volume, so that the recirculated spent liquor is introduced directly into said storage tank interior volume, and not into said mixing tank.

12. Apparatus as recited in claim 1 wherein said mixing means comprises a propeller agitator.

13. Apparatus as recited in claim 1 wherein said mixing means comprises a suction pipe mixer having an open top and an open bottom, and wherein said means for introducing spent liquor into said mixing tank introduces the spent liquor directly into said open top of said suction pipe.

14. Apparatus as recited in claim 1 wherein said storage tank has a level of liquid therein, and wherein said discharging means comprises an overflow conduit leading from a portion of said fixing tank above the liquid level to a location below the liquid level.

15. Apparatus as recited in claim 1 wherein said mixing tank further comprises one or more sidewalls disposed within said storage tank interior volume, and wherein said bottom is disposed within said storage tank interior volume.

16. A system for treating black liquor, comprising:

a black liquor storage tank having a top and a bottom, including a liquid outlet adjacent the bottom thereof, and an interior volume;

a recovery boiler connected to said liquid outlet, and producing fly ash;

a recirculating conduit connected from said recovery boiler to said storage tank interior volume;

a mixing tank remote from said recirculating conduit having a discharge opening in direct communication with said storage tank interior volume;

black liquor evaporators;

means for connecting said black liquor evaporators to said mixing tank for introducing black liquor from said evaporators into said mixing tank;

means for introducing fly ash from said recovery boiler into said mixing tank; and mixing means associated with said mixing tank for mixing black liquor and fly ash therein to produce a liquid mixture that is discharged through said discharge opening directly into said storage tank interior volume primarily by gravity flow.

* * * * *